United States Patent [19]

Reichen et al.

[11] 4,013,855

[45] Mar. 22, 1977

[54] MODULAR PUSHBUTTON SWITCH

[75] Inventors: John Erwin Reichen; Richard Neff Meyer, both of Portland; Gary William Reed, Beaverton, all of Oreg.

[73] Assignee: Tektronix, Inc., Beaverton, Oreg.

[22] Filed: Mar. 17, 1975

[21] Appl. No.: 558,580

[52] U.S. Cl. ..... 200/314; 200/159 R; 200/153 J; 200/5 R; 200/16 D

[51] Int. Cl.[2] ..... H01H 9/00

[58] Field of Search ..... 200/159 R, 159 A, 159 B, 200/314, 5 R, 5 A, 5 B, 5 C, 5 D, 5 E, 5 EA, 5 EB, 5 F, 293–307, 153 J, 16 R, 16 A, 16 B, 16 C, 16 D, 16 E, 50 C

[56] References Cited

UNITED STATES PATENTS

| | | | |
|---|---|---|---|
| 2,441,614 | 5/1948 | Baumer | 200/153 J |
| 3,248,491 | 4/1966 | Kroll et al. | 200/307 |
| 3,584,174 | 6/1971 | Sprando | 200/314 |
| 3,592,983 | 7/1971 | Kroll | 200/16 D |
| 3,770,923 | 11/1973 | Habecker | 200/153 J |
| R28,147 | 9/1974 | Hoffman | 339/17 R |

*Primary Examiner*—Robert K. Schaefer
*Assistant Examiner*—Morris Ginsburg
*Attorney, Agent, or Firm*—Adrian J. LaRue

[57] ABSTRACT

A modular pushbutton switch is removably mounted on a dielectric mounting member which has stationary contacts thereon. Contacts are removably mounted in a housing member and an actuating member moves the movable contacts and housing member into and out of engagement with the stationary contacts. Latching means is provided to maintain the movable contacts in one of two positions.

13 Claims, 24 Drawing Figures

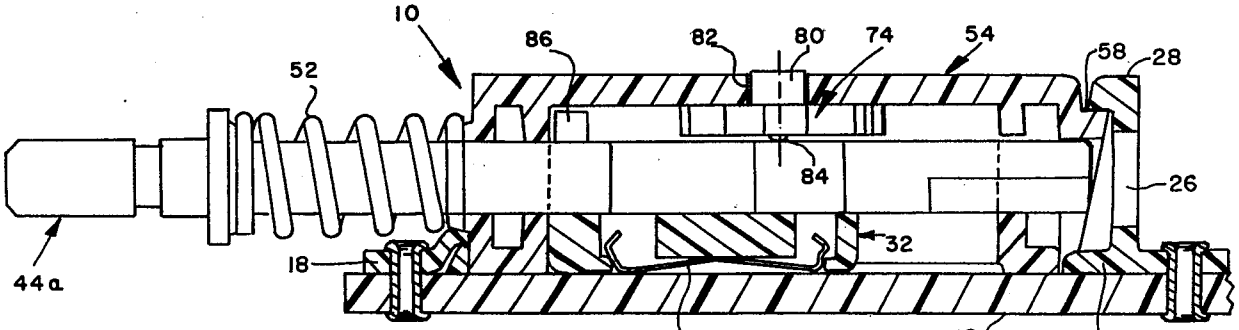
Fig-7
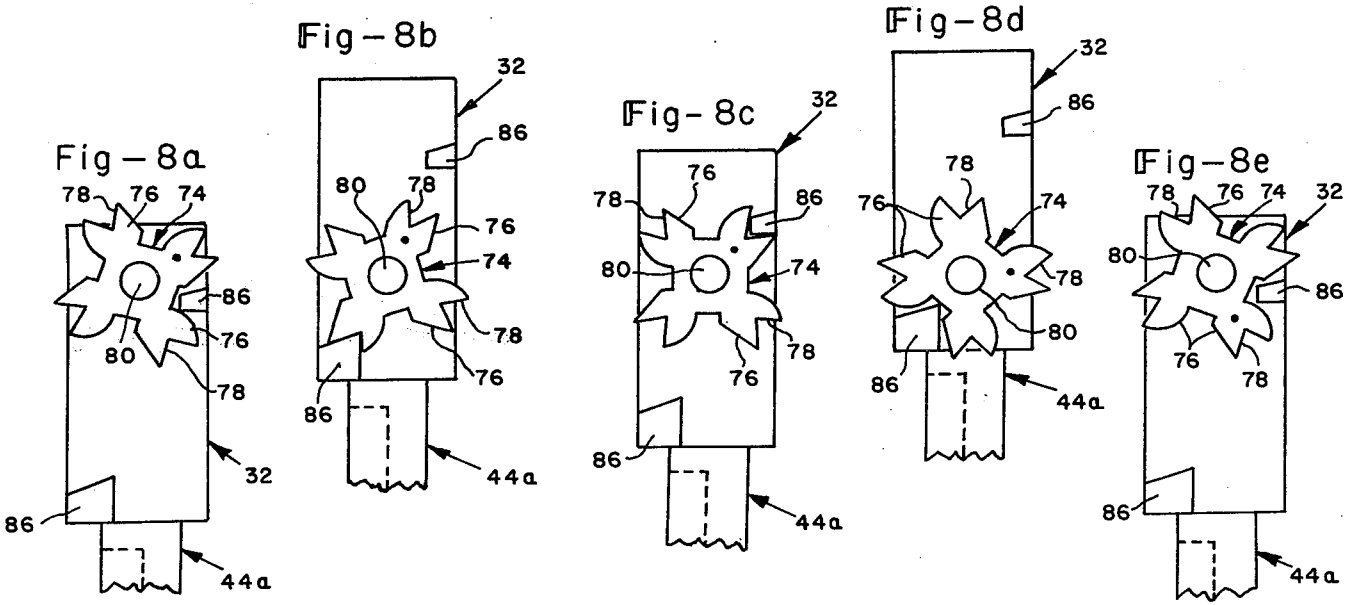

MODULAR PUSHBUTTON SWITCH

BACKGROUND OF THE INVENTION

Previous pushbutton switches are provided with a dielectric housing in which pins are mounted. A spring-biased actuator is movably mounted in the housing and it carries contact members thereon for electrical engagement with the pins to perform switching functions. A group of such pushbutton switches are mounted together. A latching member is provided for latching an actuator in position and clearing another actuated actuator.

These pushbutton switches have the following drawbacks. They are soldered in place on a printed circuit board or electrical leads soldered to the pins. This adds to the cost because of installation time. The removal of each switch of a group is very difficult. The switches cannot be mounted directly on opposite sides of a printed circuit board. They have limited switching functions. More metal is used in these switches which increases capacitance problems for high frequency applications.

SUMMARY OF THE INVENTION

The present invention is directed to switches and more particularly to pushbutton switches. The pushbutton switch includes securing means that are secured onto a mounting member having stationary contacts thereon. A housing member has engaging means that are engaged by the securing means to removably secure the housing member in position on the mounting member. A movable contact holder has contacts thereon and is positioned in the housing member for movement therewithin. A spring-biased actuator is mounted in the housing member and is operatively conected to the movable contact holder to move the movable contact holder and the contacts thereon from one position to another position with the movable contacts bridging or engaging the stationary contacts. Latching means is associated with the spring-biased actuator to latch the actuator in position in one embodiment and to unlatch an actuated actuator in another embodiment.

Such pushbutton switches provide unique advantages in relation to less installed cost, not being soldered in place, can be easily serviced, can be individually removed, can be mounted directly on opposite surfaces of a circuit back-to-back board, has expanded switching capability, better spacing requirements, ganged switching operation and less metal is used thereby decreasing capacitance for high frequency operation. These are some of the important features of the present invention.

An object of the present invention is to provide pushbutton switch means that includes housing means in which movable contact means are housed with the housing means being removably mounted on a mounting member that carries the stationary contact means.

Another object of the present invention is the provision of pushbutton switch means that are individually operated or the actuation of one switch means deactuates an actuated switch means.

A further object of the present invention is to provide pushbutton switch means that requires no soldering to connect the stationary contacts to circuitry.

An additional object of the present invention is the provision of pushbutton switch means in which housing means housing movable contact means and actuator means therefore are removably mounted on mounting means carrying stationary contact means.

A still further object of the present invention is to provide pushbutton switch means wherein the removable housing means, movable contact means and actuator means are of such construction that enables various combinations of switching capability to be provided for different kinds of switching functions.

Still an additional object of the present invention is the provision of pushbutton switch means that has low installed cost and uses less metal to enable switching of high frequency signals.

A further object of the present invention is the provision of pushbutton switch means that can be mounted so as to be operated in tandem.

An additional further object of the present invention is to provide pushbutton switch means that can be mounted on opposite sides of a mounting member carrying stationary contact means.

Yet another object of the present invention is the provision of illumination means for illuminating operated pushbutton switch means to indicate state of operation thereof.

BRIEF DESCRIPTION OF THE DRAWINGS

Other objects and advantages of the present invention will be apparent from the detailed description of preferred embodiments thereof and from the attached drawings of which:

FIG. 7 is a cross-sectional view of an alternative embodiment of the pushbutton switch;

FIGS. 8*a*, 8*b*, 8*c*, 8*d* and 8*e* illustrate the latching and unlatching action of the pushbutton switch of FIG. 7;

Figure 1:
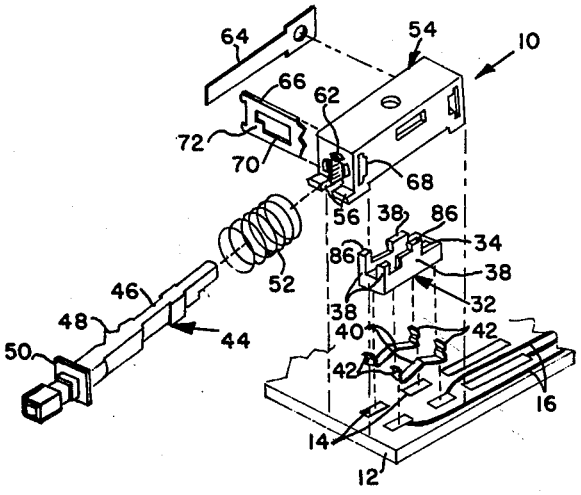
FIG. 1 is an exploded perspective view of the pushbutton switch of the present invention.
Figure 2:
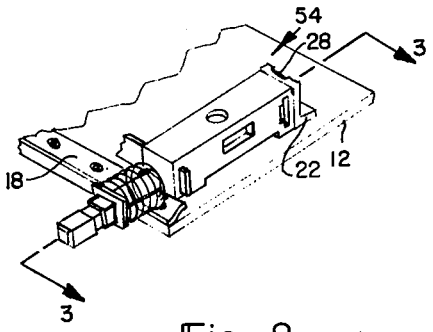
FIG. 2 is a perspective view of the pushbutton switch of FIG. 1 in an assembled condition.

Turning now to the drawings and particularly FIGS. 1–4, a pushbutton switch 10 is shown which includes a printed circuit board 12 having stationary contacts 14 thereon which have connected thereto conductive paths 16 for connection to other circuitry. Front retaining members 18 are secured onto board 12 via rivets, eyelets, screws, etc. 20 and the same is true for rear clip 22. Retaining member 18 has arcuate areas 24 and rear clip 22 comprises spring clips each having legs 26 connected together by cross member 28. An inner beveled surface 30 is provided on cross member 28.

Figure 3:
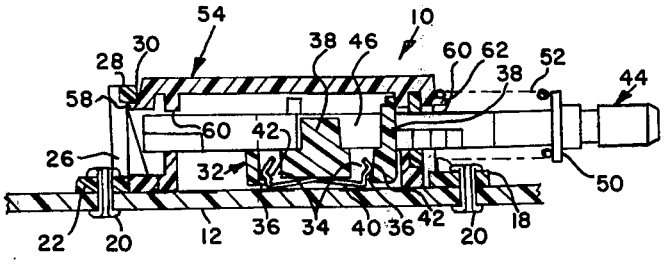
FIG. 3 is a cross-sectional view taken along the lines 3—3 of FIG. 2.
Figure 4:
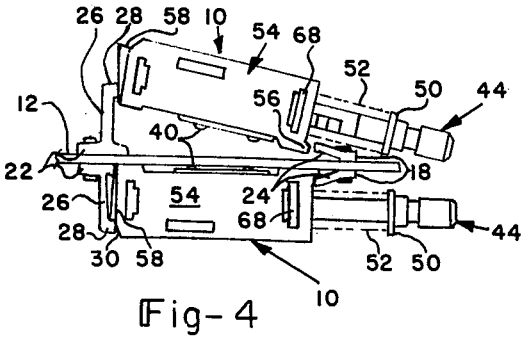
FIG. 4 is a side elevational view of a pushbutton switch in secured position on a printed circuit board and another pushbutton switch ready to be secured onto the board.
Figure 5:
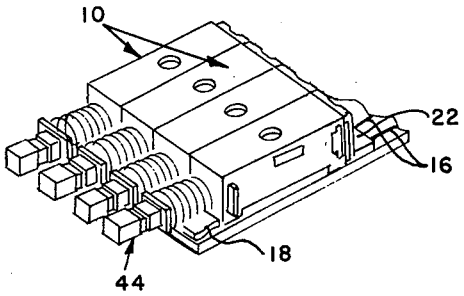
FIG. 5 is a perspective view of several pushbutton switches assembled as a modular pushbutton system.

A dielectric contact holder 32 is provided with openings 34 having lips 36 and projections 38. Electrical contacts 40 have a W-configuration. The outer legs of contacts 40 have detents 42 which engage with lips 36 when these legs are disposed in openings 34 of holder 32 whereas the bight of the inner leg engages against the bottom of holder 32, as shown in FIG. 3, to maintain contacts 40 in positon on holder 32, because the pressure of the contact areas of contacts 40, which are located at the outer ends of the inner leg, on board 12 and contact 14 forces the outer legs outwardly by virtue of the bight of the inner leg engaging the bottom of holder 32. Thus, contacts 40 bridge between the outer and center stationary contacts 14 in one position and the center and inner stationary contacts 14 in another position. The outer ends of the outer legs of contacts 40 are bent inwardly to facilitate the outer legs being disposed in openings 34 of holder 32.

An actuator 44 of suitable dielectric material is provided with a recessed area 46 which snugly fits between projections 38 of contact holder 32 so that movement of actuator 44 also moves contact holder 32 and contacts 40 thereon between pairs of statonary contacts 14. A latching and unlatching cam 48 is provided on actuator 44 and the operation thereof will be discussed in conjunction with FIGS. 6*a*–6*c*. A projection 50 is provided on actuator 44 against which one end of coil spring 52 engages to provide spring actuating pressure therefor.

A housing 54 houses contact holder 32 with contacts 40 thereon and within which contact holder 32 and contacts 40 are moved via actuator 44 and spring 52. Housing 54 is of a suitable dielectric material and includes legs 56 which mate with arcuate areas 24 of front retaining members 18 to maintain the front end of housing 54 in position on board 12 and beveled projection 58 which via its beveled surface cams rear clip 22 to enable cross member 28 to engage the flat surface of beveled projection 58 thereby securing housing 54 in position on board 12. Rectangular openings 60 are provided at each end of housing 54 to enable actuator 44 to be movably mounted therewithin. Projection 62 is provided at the front of housing 54 onto which one end of coil spring 52 is disposed.

In assembly, a retaining member 18 and rear clip 22 are secured onto a board 12, contacts 40 are mounted in position on contact holder 32. Coil spring 52 is positioned onto actuator 44 and actuator 44 is positioned in openings 60 of housing 54 with coil spring disposed on projection 62. Contact holder 32 is mounted onto area 46 of actuator 44 and this maintains actuator 44 in position with spring 52 maintaining actuator 44 in an outer position. Actuator 44 extends through housing 54 and is movable relative thereto. Legs 56 are positioned in arcuate areas 24 and housing 54 is pushed toward board 12 with the beveled surface of beveled projection 58 camming clip 22 away from its normal position until the beveled cross member 28 of clip 22 engages the flat surface of beveled projection 58 of housing 54 thereby removably securing housing 54 in position.

In order for the pushbutton switches to operate via latching and unlatching cam 48, at least two pushbutton switches have to be secured in position adjacent each other as heretofore described. A leaf spring 64 has one end secured to housing 54 while the other end engages a latch bar 66 which is movably disposed in an opening 68 at the front end of housing 54. Latch bar 66 has an opening 70 through which actuator 44 passes for each push button switch 10. A cam-engaging section 72 is provided in each opening 70 for engagement with cam 48.

Figure 6A:
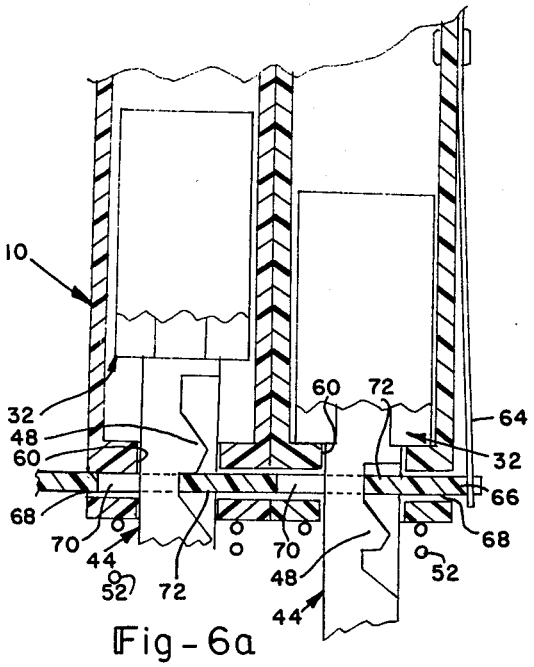
FIGS. 6*a*, 6*b* and 6*c* illustrate the latching and releasing mechanism for actuators of pushbutton switches assembled in modular fashion.
Figure 6B:
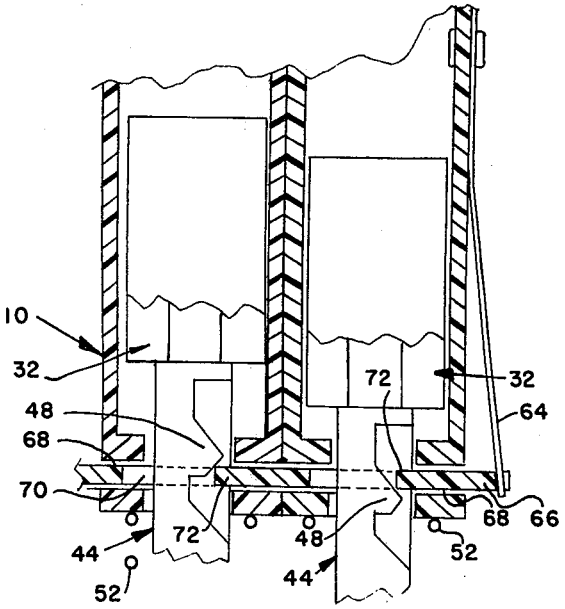
Figure 6C:
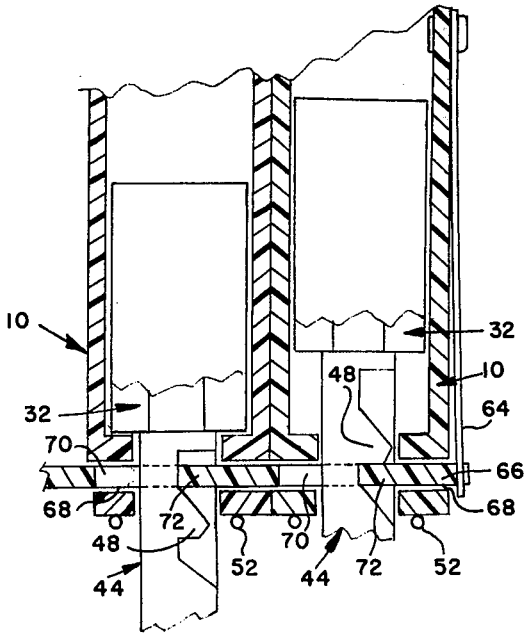

As shown in FIGS. 6*a* – 6*c*, the operation of the latching means is illustrated. FIG. 6*a* shows the left hand switch with actuator 44 in a latched position whereas the actuator 44 of the right hand switch is in an unlatched or released position. When the actuator 44 of the right hand switch is pushed inwardly, the inner beveled surface of cam 48 engages cam-engaging section 72 thereby moving latch bar 66 against spring 64 whereby the cam-engaging section 72 in the left hand switch has moved from its latched position against the front flat surface of cam 48 of actuator 44 and along the front beveled surface thereof under the influence of coil spring 52 as shown by FIG. 6*b*. Further pushing on the right hand actuator 44 enables section 72 to move along the front beveled surface of cam 48 and into engagement with the front flat surface thereof via spring 64 forcing latch bar 66 leftwardly thus latching the right hand actuator 44 in a latched position and spring 52 moves the left hand actuator 44 to an unlatched position. A number of push button switches can be mounted in position and any actuator thereof can be moved to a latched position and in so doing will unlatch any latched actuator as described via latch bar 66, respective cam-engaging sections 72 and spring 64.

Turning now to FIGS. 7 and 8*a* – 8*e*, an alternative embodiment of the pushbutton switch 10*a* which is commonly referred to as a push-push version. The parts of the switch of FIGS. 7 and 8*a* – 8*e* are the same as those of the switch of FIGS. 1–6 except that actuator 44*a* has no latching and unlatching cam 48 so that this switch can be included with the latching version of FIGS. 1–6 because actuator 44*a* can extend through the opening 70 of latching bar 66 without affecting the operation of the switches using latching bar 66.

A starwheel 74 is provided with equally-spaced legs 76 having V-shaped slots 78 therein. An annular projection 80 is frictionally disposed in hole 82 in housing 54 to enable starwheel 74 to rotate and a radiused projection 84 rides on actuator 44*a* which maintains the starwheel 74 in position.

Diagonal projections 38 of contact holder 32 have lugs 86 thereon which engage legs 76 during movement of contact holder 32 via actuator 44*a*. FIGS. 8*a* – 8*e* illustrate the operation of the starwheel. FIG. 8*a* shows actuator 44*a* in its normally inoperative or unlatched position with spring 52 maintaining actuator 44*a* and contact holder 32 in its outer position as shown in FIG. 7. Inward pressure applied to actuator 44*a* moves it and contact holder 32 along housing 54 so that inner lug 86 normally disposed between adjacent right legs 76 of starwheel 74 will engage the inner right leg and rotate the starwheel counter clockwise to a position as shown in FIG. 8*b* with the V-shaped slot 78 of outer left leg 76 being positioned so that outer lug 86 mates with such slot thereby causing starwheel 74 to rotate clockwise to position slot 78 of right inner leg 76 in alignment with inner lug 86.

As actuator 44*a* and contact holder 32 move outwardly under the influence of spring 52, inner lug 86 mates with slot 78 of right outer leg 76, as shown in FIG. 8*b*, thereby causing starwheel 74 to rotate clockwise so that the right inner leg 76 wedges against inner lug 86 to latch contact holder 32 in a latched position as illustrated by FIG. 8*c*.

To unlatch contact holder 32, actuator 44*a* is pushed inwardly, outer lug 86 engages left outer leg 76 of starwheel 74 thereby rotating starwheel 74 clockwise to the position shown in FIG. 8*d* and contact holder 32 and actuator 44*a* are returned to their normally inoperative position under the influence of spring 52 and in so doing inner lug 86 engages right outer leg 76 continuing the clockwise rotation of starwheel 74 until inner lug 86 rests between inner and outer right legs 76 as shown in FIG. 8*e*. Thus, the pushbutton switch is ready to operate again to a latched condition via starwheel 74 and inner and outer lugs 86 to move contacts.

Figure 9:
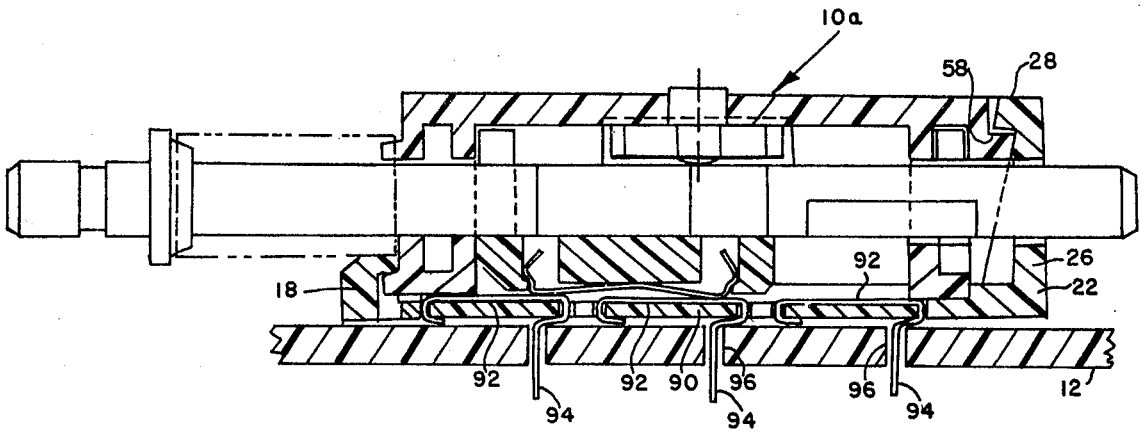
FIG. 9 is a cross-sectional view of an additional embodiment of the pushbutton switch.

FIG. 9 is the same as FIG. 7 except that instead of front retaining members 18 and rear clip 22 being riveted to board 12, they are connected together as one piece via intermediate member 90 of the same material as members 18 and clip 22. Member 90 carries stationary contacts 92. Extensions 94 of contacts 92 extend outwardly at right angles to member 90 and they extend through openings 96 in board 12 and are flow soldered onto circuit paths thereon. The same mounting can be used with the pushbutton switch of FIGS. 1–4 in the same manner.

Figure 10:
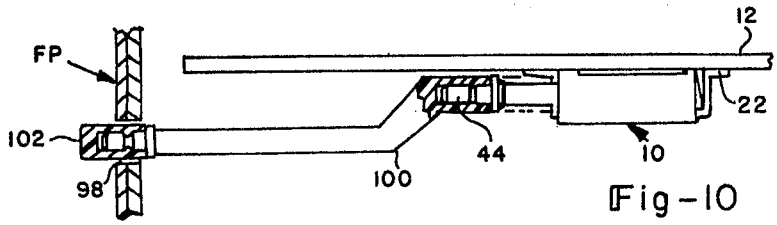
FIGS. 10–14 illustrate various schematic uses of the switches.

FIGS. 10–14 illustrate various ways the present invention can be used. FIG. 10 shows a front panel FP of an instrument (not shown) having an opening 98 through which one end of an extension shaft 100 extends. Shaft 100 is offset and its inner end is snapably attached to actuator 44 of switch 10 removably mounted on board 12 which can be a master board containing other electrical circuitry. This enables the switch 10 to be positioned at selected locations on board 12. A cap 102 is snapably secured onto shaft 100 and it can be colored if desired. Cap 102 extends outwardly beyond the front of the front panel.

Figure 11:
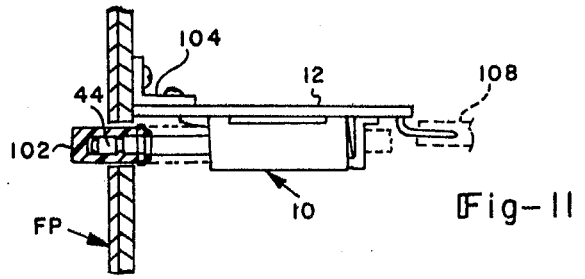

FIG. 11 illustrates a panel mounted version whereby circuit board 12 on which switch 10 is removably mounted is secured onto panel FP via mounting bracket 104. A cap 102 can be snapably secured onto actuator 44. Electrical pins 106 are electrically connected to circuit paths on board 12 and these pins are electrically connected to connectors in a connector housing 108 which can be of the type disclosed in U.S. Pat. No. Re 28,147.

Figure 12:
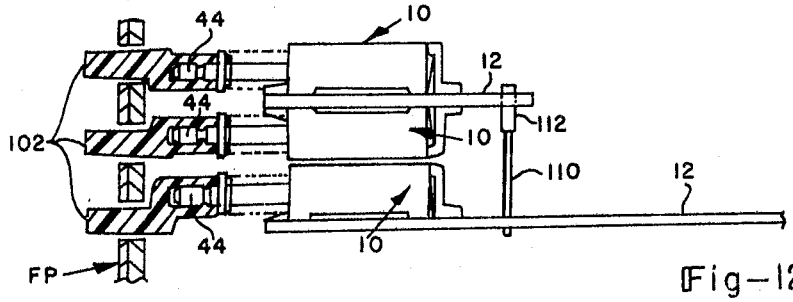

Switches 10 are mounted on top and bottom surfaces of daughter circuit board 12 which is electrically connected to mother circuit board 12 via pins 110 and sockets 112 as shown in FIG. 12. Mother circuit board 12 also has a switch 10 thereon. Caps 102 are snapably secured onto actuators 44.

Figure 13:
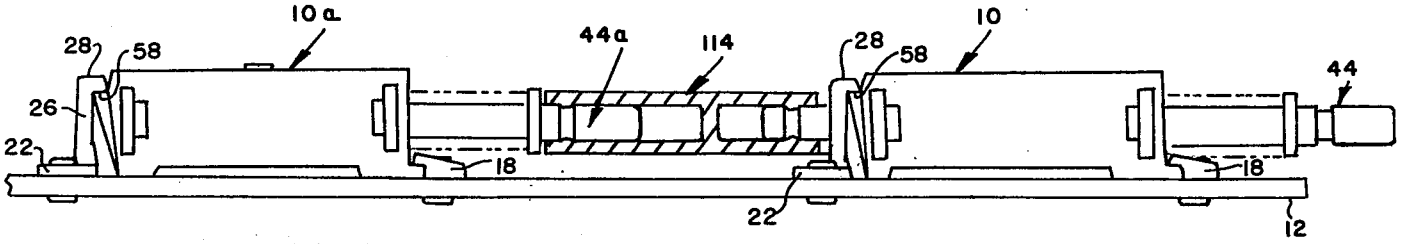
Figure 15:
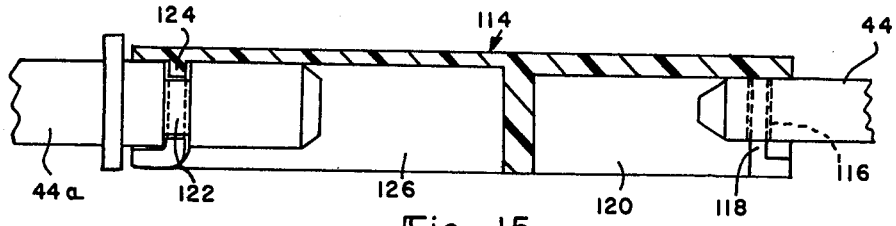
FIG. 15 is a cross-sectional view of a coupling member for coupling switch actuators for tandem operation.
Figure 16:
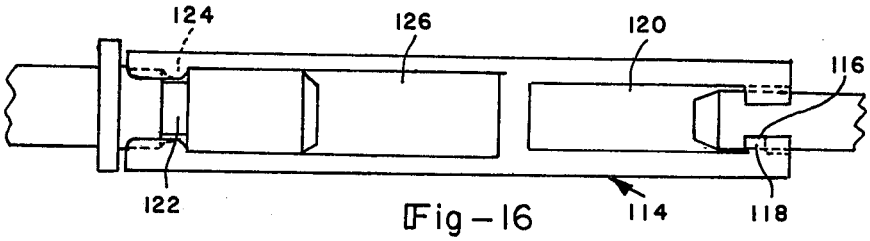
FIG. 16 is a bottom plan view of couping member.

In line tandem switches 10 and 10*a* are illustrated in FIG. 13 which are secured onto circuit board 12; however, switches 10 or switches 10*a* can be utilized as desired. Actuator 44 is coupled to actuator 44*a* via coupling member 114 which is best illustrated in FIGS. 15 and 16. The inner end of actuator 44 is provided with a slot 116 into which a projection 118 located in an end of U-shaped section 120 is disposed. The outer end of actuator 44*a* is provided with an annular recess 122 into which U-shaped projection 124 located in an end of U-shaped section 126 is disposed. In this way, actuators of aligned switches are connected to be operated in tandem.

Figure 14:
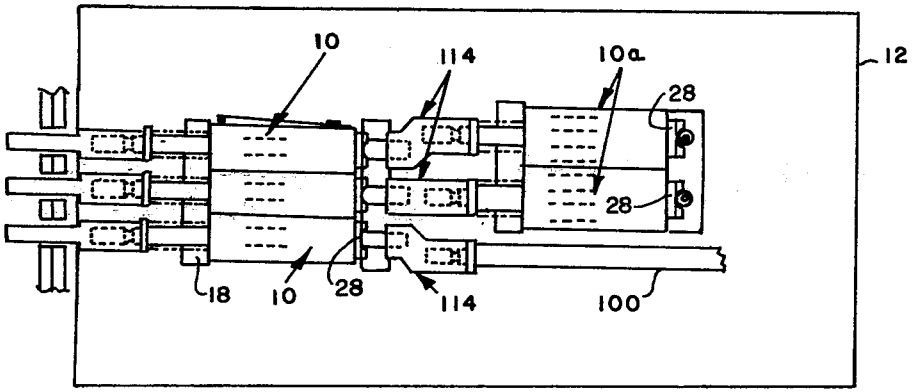
Figure 17:
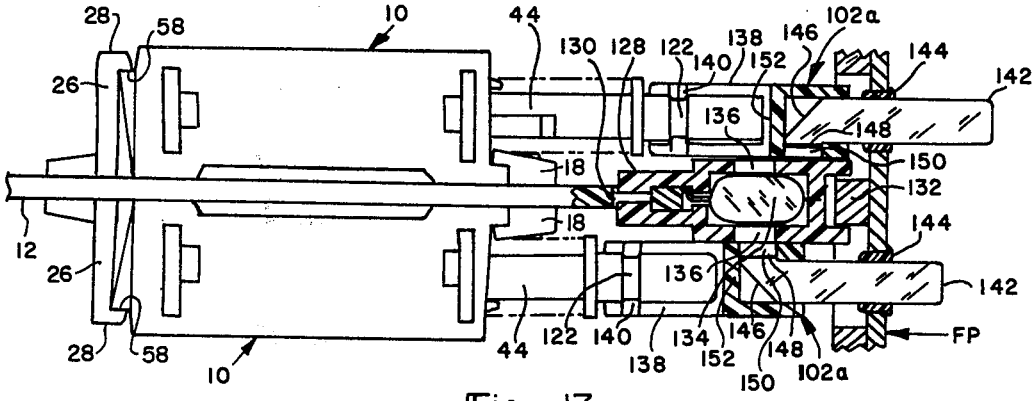
FIG. 17 is a cross-sectional view of light means for the switches.

FIG. 14 illustrates a further arrangement of the switches with switches 10 arranged in a row or rows on a circuit board or boards 12. switches 10*a* arranged in a row or row on board or boards 12 and the actuators of some of switches 10 operatively connected to the actuators of switches 10*a* via coupling members 114 and a switch 10 actuator is operatively connected to an extension shaft 100 via coupling member 114 with extension shaft 100 being connected to a switch 10*a* (not shown) located at another location on board 12. FIG. 17 illustrates switches 10 removably secured onto top and bottom surfaces of circuit board 12 in like manner as FIG. 4. A housing 128 is mounted between an opening 130 in board 12 and a projection 132 on front panel FP. A light bulb 134 is located in housing 128 in alignment with openings 136 therein so that light from light bulb 134 can be transmitted out of housing 128 through openings 136. Light bulb 134 is connected to power (not shown) to energize it. A cap 102*a* is provided with spring legs 138 (only one being shown) having projections 140 that mate with recess 122 of actuator 44 to snapably secure cap 102*a* thereon. A light pipe 142 of clear plastic material having good light transmitting characteristics is disposed in cap 102*a* and it extends through plastic bushings 144 in front panel FP. The part of light pipe 142 in cap 102*a* has a bevel surface 146 opposite flat surface 148 which are in alignment with a hole 150 in cap 102*a*. Light pipes 142 can be of any desired color.

When an actuator 44 is actuated as bottom actuator 44 is in FIG. 17, hole 150 of cap 102*a* is in alignment with a respective opening 136 in light housing 128 so that light from light bulb 134 passes therethrough and into light pipe 142 through flat surface 148 whereupon the light is reflected from beveled surface 146 and along light pipe 142. This provides a visual indication of which switches are operated. The top actuator 44 of FIG. 17 is in a normally-inoperative position and the light pipe thereof will not of course receive any light from light bulb 134 because wall 152 of cap 102*a* will shut off any transmission of light.

If desired, light bulb 134 can be associated with a light pipe to provide light to a number of light pipes 142 in the manner of the teaching of U.S. Pat. No. 3,584,174. Alternatively, actuators 44 and 44*a* can be made of light transmitting material and light bulb 134 can be disposed at an inner end of the actuators which would be provided with a beveled surface to reflect the light therealong.

Figure 18:
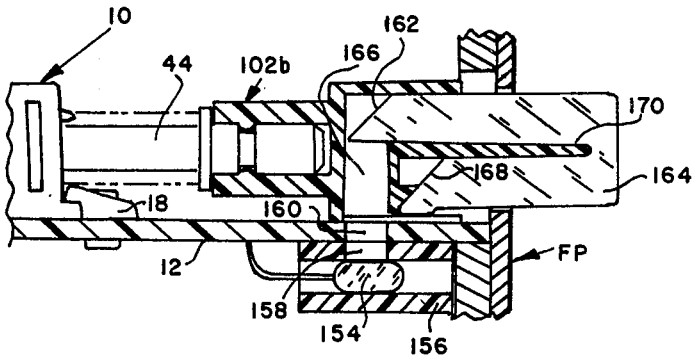
FIG. 18 is a part cross-sectional view of an alternative light means for the switches.

FIG. 18 illustrates another embodiment of light means for indicating the operational condition of a switch. Light bulb 154 is located in housing 156 secured onto circuit board 12 having switch 10 secured thereon. Aligned holes 158 and 160 in housing 156 and in board 12 permit light from light bulb 154 to pass to beveled surface 162 of light pipe 164 via channel 166 of cap 102*b* when the switch actutor 44 is in one position so that light reflected from beveled surface 162 is transmitted along light pipe 164. When actuator 44 is in another position, beveled surface 168 receives light from light bulb 154 because of being in alignment with aligned holes 158, 160 and the light is reflected from beveled surface 168 and transmitted along light pipe 164. Light pipe 164 extends through an opening in front panel FP and is formed into two sections and mounted on divider 170 of cap 102*b* which acts as a shutter to prevent light from one lighted section to be transmitted to the non-lighted section. Cap 102*b* is mounted on actuator 44 in the same manner as cap 102*a*. Each of the light pipe sections can have a different color if desired.

As can be discerned, a unique pushbutton switch has been disclosed. Various changes may made in the foregoing embodiments without departing from the scope of the invention. Therefore, it is not intended to limit the scope of the present invention to the described and illustrated embodiments but to that of the following claims.

The invention is claimed in accordance with the following:

1. Pushbutton switch means comprising:
dielectric means having spaced stationary electrical contact means;
housing means having a contact-carrying means movably disposed therein;
movable electrical contact means mounted on said contact-carrying means for electrical engagement with said stationary electrical contact means;
retaining means provided by said dielectric means and said housing means for latchably retaining said housing means onto said dielectric means;
spring-biased actuator means extending through said housing means and being connected to said contact-carrying means for moving said contact-carrying means and said movable electrical contact means thereon between first and second positions so that said movable electrical contact means moves into and out of electrical engagement with said stationary electrical contact means; and
latching means provided in said housing means and by said actuator means and being movable by actuation of said actuator means to latch said contact-carrying means in one of said first and second positions.

2. Pushbutton switch means according to claim 1 wherein said retaining means comprise retaining members and clip members secured onto said dielectric means and legs of said housing means are postioned in said retaining members and flat surfaces on said housing means are engaged by said clip members.

3. Pushbutton switch means according to claim 1 wherein said latching means comprise cam means on said actuator means and spring-biased latch bar means movably mounted in said housing means and having cam-engaging means for engagement with said cam means.

4. Pushbutton switch means according to claim 1 wherein said latching means comprise starwheel means having equally-spaced legs rotatably mounted in said housing means and diagonal projection means provided by said contact-carrying means for engaging said legs to position said starwheel means for latching engagement with one of said projection means.

5. Pushbutton switch means according to claim 1 wherein said dielectric means and said retaining means are connected together as one piece, said stationary electrical contact means include extensions for connection with circuit paths of a printed circuit board.

6. Pushbutton switch means according to claim 1 wherein cap means are secured onto said actuator means including light pipe means and light means is provided on said dielectric means, said light pipe means being in alignment with said light means when said actuator means is in one of the latched positions and transmitting light via said light pipe means to indicate an actuated condition of said switch means.

7. Pushbutton switch means according to claim 1 wherein said actuator means has cap means secured thereon, dual light pipe means disposed in said cap means, light means provided on said dielectric means, each of said dual light pipe means adapted to be aligned with said light means depending upon the position of said actuator means to indicate the operated condition of said switch means.

8. Pushbutton switch means according to claim 1 wherein said switch means are disposed in alignment with the actuator means thereof being disposed in axial alignment but spaced from each other, coupling means connecting the rear of one actuator means with the front of another actuator means so that actuation of said one actuator means will actuate said another actuator means.

9. Pushbutton switch means according to claim 1, wherein said contact-carrying means have openings provided with lips, said movable electrical contact means have outer legs and an inner leg, said outer legs being disposed in said openings and having detents engaging said lips, said inner leg having a bight engaging a bottom surface of said contact-carrying means between said openings.

10. A switching device comprising:
mounting means having stationary electrical contact means thereon;
a plurality of housing means having movable contact-carrying means movably disposed in each of said housing means, said contact-carrying carrying means having movable electrical contact means thereon;
retaining means provided by said mounting means and said housing means for retaining said housing means in position on said mounting means for enabling said movable electrical contact means to be in electrical engagement or out of electrical engagement with said stationary electrical contact means;
an actuator means extending through each of said housing means and connected to the contact-carrying means therein for moving said contact-carrying means and said movable electrical contact means into and out of electrical engagement with said stationary electrical contact means; and
latch means provided by said actuator means including movable latch bar means for latching one of said actuator means in an operated position and for releasing another of said actuator means which is in an operated position when said one actuator means is moved to said operated position.

11. A switching device according to claim 10 wherein a further of said actuator means extends freely through said latch bar means, said housing means of said further actuator means and said contact-carrying means movably disposed therein have latching means for latching said contact-carrying means in an operated position independent from said latch means.

12. A switching device according to claim 10 wherein further housing means having further contact-carrying means provided with movable electrical contact means thereon is retained on said mounting means by further retaining means for electrical engagement with further stationary electrical contact means on said mounting means, further actuator means for said further contact-carrying means and being in alignment with a selected one of said actuator means, and coupling means coupling said selected one of said actuator means with said further actuator means and to be actuated thereby.

13. A switching device according to claim 10 wherein illumination means is provided for selectively transmitting light through ends of said actuator means when the selected actuator means has been moved to said operated position and into light-coupling relationship with said illumination means thereby illuminating an outer end of said selected actuator means to indicate operation thereof.

* * * * *